US005172995A

United States Patent [19]

Felgentreu

[11] Patent Number: 5,172,995

[45] Date of Patent: Dec. 22, 1992

[54] PLOTTER PEN WITH COAXIAL RESERVOIR

[75] Inventor: Peter Felgentreu, Hamburg, Fed. Rep. of Germany

[73] Assignee: Koh-I-Noor Inc., Bloomsbury, N.J.

[21] Appl. No.: 687,748

[22] Filed: Apr. 19, 1991

[30] Foreign Application Priority Data

Apr. 27, 1990 [DE] Fed. Rep. of Germany ..... 40135101

[51] Int. Cl.[5] ..... B43K 8/16

[52] U.S. Cl. ..... 401/258; 401/217; 401/260; 346/140 A

[58] Field of Search ..... 401/258, 259, 260, 217; 346/140 A

[56] References Cited

U.S. PATENT DOCUMENTS

| | | | |
|---|---|---|---|
| 1,352,340 | 9/1920 | App | 401/258 |
| 1,447,632 | 3/1923 | Schmidt | 401/258 |
| 2,397,229 | 3/1946 | Bird | 401/217 |
| 2,504,649 | 4/1950 | Chesler | 401/217 |
| 3,459,486 | 8/1969 | Matschkal | 401/259 |
| 3,741,668 | 6/1973 | Danjzcek et al. | 401/258 |
| 4,770,558 | 9/1988 | Frietsch | 401/217 X |

FOREIGN PATENT DOCUMENTS

| | | | |
|---|---|---|---|
| 1013545 | 7/1952 | France | 401/217 |

*Primary Examiner*—Steven A. Bratlie

*Attorney, Agent, or Firm*—Fitzpatrick, Cella, Harper & Scinto

[57] ABSTRACT

A stylo pen tip, in particular for use in drafting plotters, has a writing tube (5) in the front end, into which a cleaning wire (6) extends from the rear, which is fixed at the front end of a drop weight body (7) which is movable back and forth axially to a limited degree in an inner bore (8). The inner bore (8) is connected with a writing fluid reservoir (4), which surrounds at least the front section of the inner bore. Coaxially to the inner bore (8), a pressure equalization chamber (11) is provided, the inner end of which is connected with the writing fluid reservoir (4) and the outer end of which is connected with ambient air. At least a portion of the pressure equalization chamber (11) is surrounded by the writing fluid reservoir (4). The inner end of the pressure equalization chamber (11) lies on the front end of the inner bore and its outer end in the area of the back end of the stylo pen tip.

11 Claims, 3 Drawing Sheets

PLOTTER PEN WITH COAXIAL RESERVOIR

BACKGROUND OF THE INVENTION

1. Field of the Invention

The invention relates to a technical pen configured particularly for use in drafting plotters, with a writing tube provided in the front end into which a cleaning wire extends from the rear. The cleaning wire is fixed at the front end of a drop weight body which is movable back and forth axially to a limited degree in an inner bore. The inner bore is connected with a writing fluid reservoir, that is coaxial to the inner bore and a pressure equalization chamber. The inner end of the pressure equalization chamber is connected with the writing fluid reservoir and the outer end of the pressure equalization chamber is connected with the ambient air.

2. Brief Description of the Prior Art

Technical pens are known to have various shapes. A pressure equalization chamber is customarily provided in a wall surrounding the inner bore. The inner end of the pressure equalization chamber generally is connected via the inner bore with the writing fluid reservoir. The outer end of the pressure equalization chamber is located in an area of the front end of the inner bore that is close to the back end of the writing tube and is open towards the front. The writing fluid reservoir is formed by a cartridge or the like, and is disposed behind the inner bore. In this way the writing fluid generally enters the inner bore axially through an opening provided on the back end of the inner bore.

When a technical pen of the known type is used as a hand-held instrument, the writing fluid entering the pressure equalization chamber may possibly dry out in the chamber. This may lead to soiling of the pressure equalization chamber, which may even result in adjoining parts sticking to each other so that they are very difficult to separate.

When a technical pen is used as a so-called plotter pen, i.e. as the writing element in the plotter head of a plotter, this difficulty occurs in an even more pronounced way, because the front end of the writing tube of the technical pen is placed on the drafting surface with a bump when the plotter head is lowered. The bumps result in the writing fluid in the area of the pressure equalization chamber being tossed forward. Hence, the danger of writing fluid drying out and clogging the equalization chamber is increased.

OBJECT AND SUMMARY OF THE INVENTION

It is the object of the invention to produce a technical pen with a reduced risk of soiling and sticking in the area of the pressure equalization chamber.

To attain this object, a technical pen of the type mentioned above is designed by means of the present invention in such a way that the writing fluid reservoir forms an annular chamber which coaxially surrounds at least the front section of the inner bore, and at least a portion of the pressure equalization chamber. The writing fluid reservoir is connected at its front end with the inner bore via at least one lateral opening. The inner end of the pressure equalization chamber is on the front end of the inner bore and the outer end of the pressure equalization chamber is provided in the area of the back end of the technical pen.

Thus, in a technical pen in accordance with the invention, the inner end of the pressure equalization chamber is located at a front end of the pen tip, and in an area that is surrounded by writing fluid. In this way, a direct connection between the writing fluid reservoir and the pressure equalization chamber is provided. Forces caused by a hard contact of the writing tube with the writing surface, or even by a shaking, will move writing fluid from the pressure equalization chamber forward and into the area of the writing fluid reservoir, but not into a normally empty area of the pressure equalization chamber. In this way, the above-described difficulties caused by soiling of the pressure equalization chamber and by drying of the writing fluid therein are prevented to a large extent.

In one embodiment of the invention, the exterior wall of the writing fluid reservoir is formed by a front part into which an interior part containing the writing tube and the inner bore has been inserted. In this embodiment, the pressure equalization chamber concentrically surrounds the inner bore. This structure is particularly compact and requires only a small number of individual components, which can be simply and easily assembled. The pressure equalization chamber also can extend backwards beyond the back end of the writing fluid reservoir, so that this chamber has a greater axial length than that of the writing fluid reservoir. An open channel structure of the pressure equalization chamber in an area behind the writing fluid reservoir can be covered by a resilient, open-pored material which is in contact with the ambient air. In this way, the outer end of the pressure equalization chamber is maintained at ambient pressure through the open-pored material, and air needed to compensate for the pressure loss caused by the delivery of writing fluid can enter through the open-pored material, and into the pressure equalization chamber. Because an absorbency also then is provided, if required, the open-pored material also prevents penetration of writing fluid into the surroundings.

The covering of an open channel structure of the pressure equalization chamber in the area of the writing fluid reservoir may consist of a cylinder wall fixedly connected with the front part.

Where such a technical pen is non-refillable, and intended to be used in a drafting plotter only until a factory-installed amount of writing fluid has been used up, it is practical to provide the option of a technical pen tip that is shipped in a locked position, from the factory. Immediately prior to use, the user then brings the pen tip into an operational position where writing fluid can be discharged through the writing tube. For this purpose, an interior part of the technical pen tip can be displaced between a retracted locked position, where the cylinder wall seals off the at least one lateral opening between the writing fluid reservoir and the inner bore, and a forward operating position, in which the at least one lateral opening connects the writing fluid reservoir and the inner bore.

In another embodiment of a technical pen in accordance with the invention, the pressure equalization chamber is located behind the inner bore. However, in this embodiment, the inner end located at the front end of the pressure equalization chamber also is surrounded by the writing fluid reservoir, so that bumping and shaking movements, at most, will force any writing fluid from the pressure equalization chamber back into the writing fluid reservoir, and not into an otherwise empty area of the pressure equalization chamber.

In this structure, the entire pressure equalization chamber may be surrounded by the writing fluid reservoir of the pressure equalization chamber and a back end may be connected with ambient air via a tube section, that is sealed with respect to the writing fluid reservoir.

The wall of the inner bore and the section having an open channel structure of the pressure equalization chamber may be made of one piece, resulting in a particularly simple structure.

The exterior wall of the pressure equalization chamber can be formed by a chamber part, on the front end of which the writing tube is provided. The invention now will be described in further detail, with reference to the drawings which illustrate the exemplary embodiments.

DETAILED DESCRIPTION OF THE PREFERRED EMBODIMENTS

Figure 1:
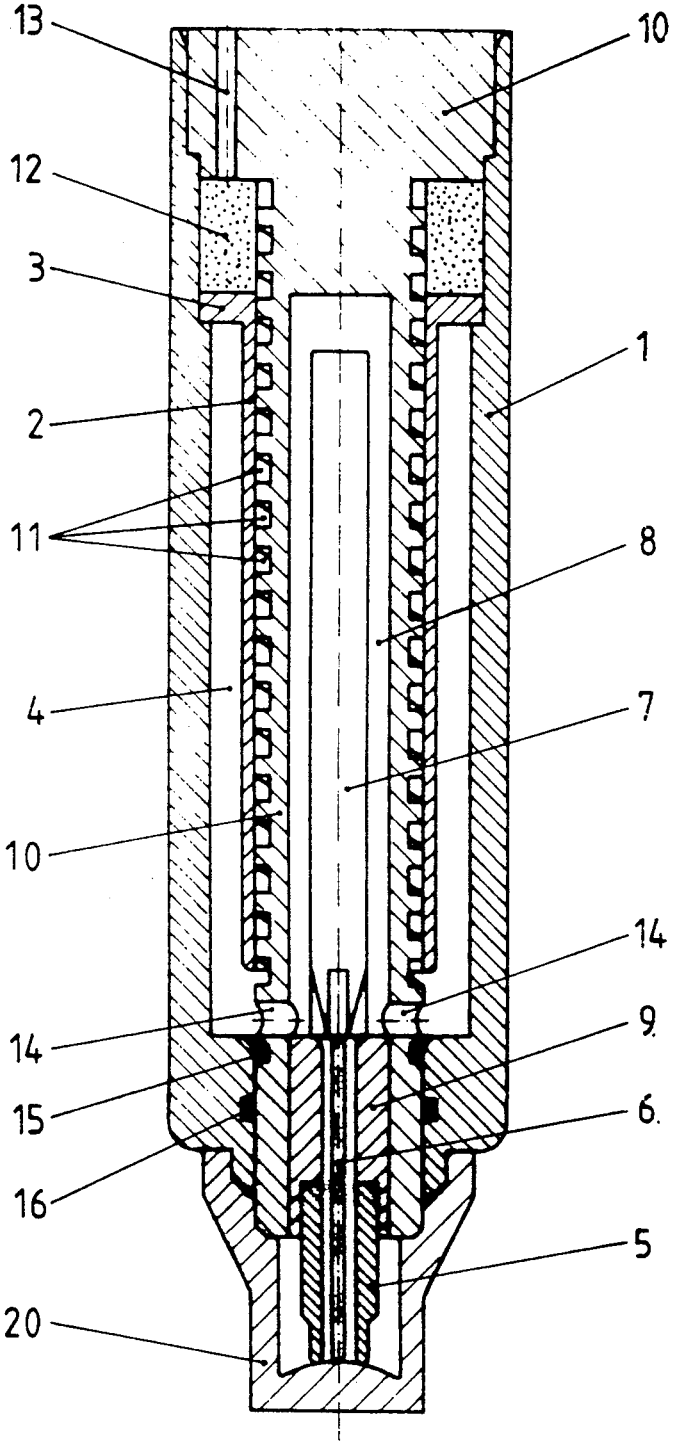
FIG. 1 is a sectional view of a technical pen in the operational position in accordance with the present invention.
Figure 2:
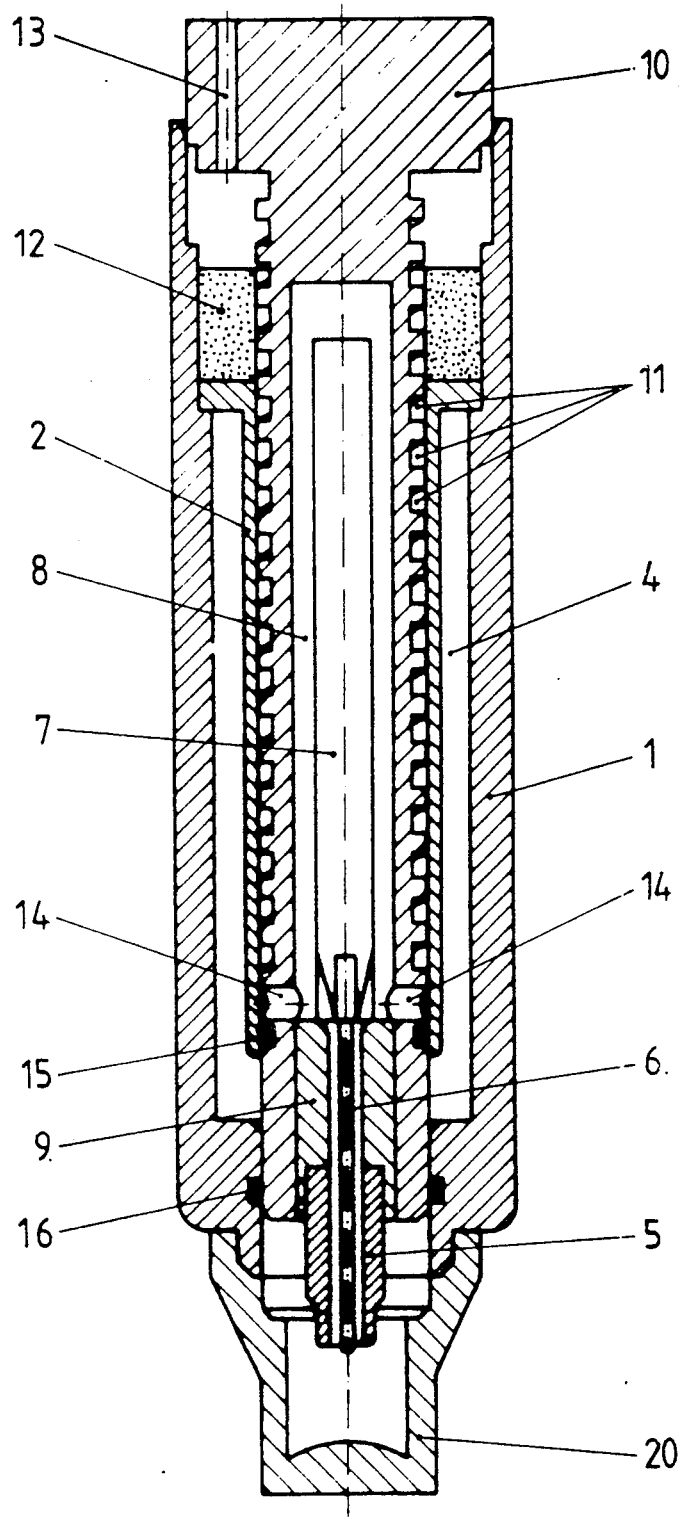
FIG. 2 is a sectional view of the technical pen of FIG. 1 when in the initial, or locked position.

The technical pen illustrated in FIGS. 1 and 2 is intended particularly for use in a drafting plotter. However, the basic structure is also usable as a manual writing or drafting instrument. The technical pen illustrated has a front part 1, into which an interior part 10, and has been inserted from the rear. The interior part is sealingly seated at its front area by means of seals 15, 16 in a central opening of the front part 1 (FIG. 1). The interior part 10 has an inner bore 8 that is closed towards the back, and at the front a bushing element 9 has been fixedly inserted, from the front. The bushing element 9 has an axially extending central opening, and a front end in which a writing tube 5 has been fixed. A drop weight body 7 located in the inner bore 8 is movable back and forth, in an axially limited manner. A cleaning wire 6 fastened to the front end of the drop weight body extends through the central opening of the bushing element 9 and into the writing tube 5.

A helical groove is formed as an open channel structure on the outside of the interior part 10, and is covered over the major part of its axial extension by a cylinder wall 2, so as to form a pressure equalization chamber 11, opening towards the front part. An annular flange 3 formed on the back end of the cylinder wall 2, is fixedly connected with the interior wall of the front part 1 by ultrasound welding or gluing, for example. That portion of the helical groove which extends backward beyond annular flange 3 is covered by means of an elastic, open-pored plastic material 12, which is in contact with the ambient air by means of a paraxial bore 13 provided in the interior part 10.

An annular chamber forming the writing fluid reservoir 4 is formed between the cylinder wall 2 and the front part 1, which on its front end is in contact with the inner bore 8 by means of two lateral openings 14 extending through the wall of the interior part 10.

A conventional protective cap 20 may be removably pushed from the front onto the tip of the technical pen. While in place, the bottom wall of the protective cap 20 sealingly contacts the front end of the writing tube 5.

In the course of manufacturing the technical pen illustrated a writing fluid, for example drafting ink, is first introduced into the annular chamber 4 between the front part 1 and the cylinder wall 2. Then, the interior part 10 is inserted from the back, so that it assumes the position in accordance with FIG. 2, where the cylinder wall 2 sealingly adjoins with its front end the exterior wall of the interior part 10 by means of the annular seal 15 and keeps the lateral openings 14 sealed against the writing fluid reservoir 4. In this position, the annular seal 16 in the wall of the central opening of the front part 1 seals the writing fluid reservoir 4 because of an interaction of the exterior wall of the interior part 10 with the annular seal 16. The tip of the technical pen is then in a locked position.

When the technical pen is to be used, the user pushes the interior part 10 forward into the position according to FIG. 1. In this operational position, the inner bore 8 is connected by means of the lateral openings 14 with the writing fluid reservoir 4. Writing fluid can then leave the writing fluid reservoir, enter the inner bore 8 and reach the writing tube 5. Thus it then is possible to write or draw with the technical pen when it is in this operational position.

When in the operational position in accordance with FIG. 1, the pressure equalization chamber 11 with its front end is in direct contact with the writing fluid reservoir. The back or outer end of the pressure equalization chamber is covered by an open-pored material, which, if desired, is also an absorbing material 12. This material 12 is in contact with the ambient air by means of the paraxial bore 13. When the pressure in the interior of the technical pen is increased, writing ink can be transferred from the front or inner end of the pressure equalization chamber 11, to the interior channels. Air is bled off into the surroundings by means of the open-pored material 12 and the paraxial bore 13 in order to cause the needed equalization of pressure. Correspondingly, when pressure is reduced, air is aspirated via the paraxial bore 13, the open-pored material 12 and the pressure equalization chamber 11 into the writing fluid reservoir 4 and the inner bore 8.

Figure 3:
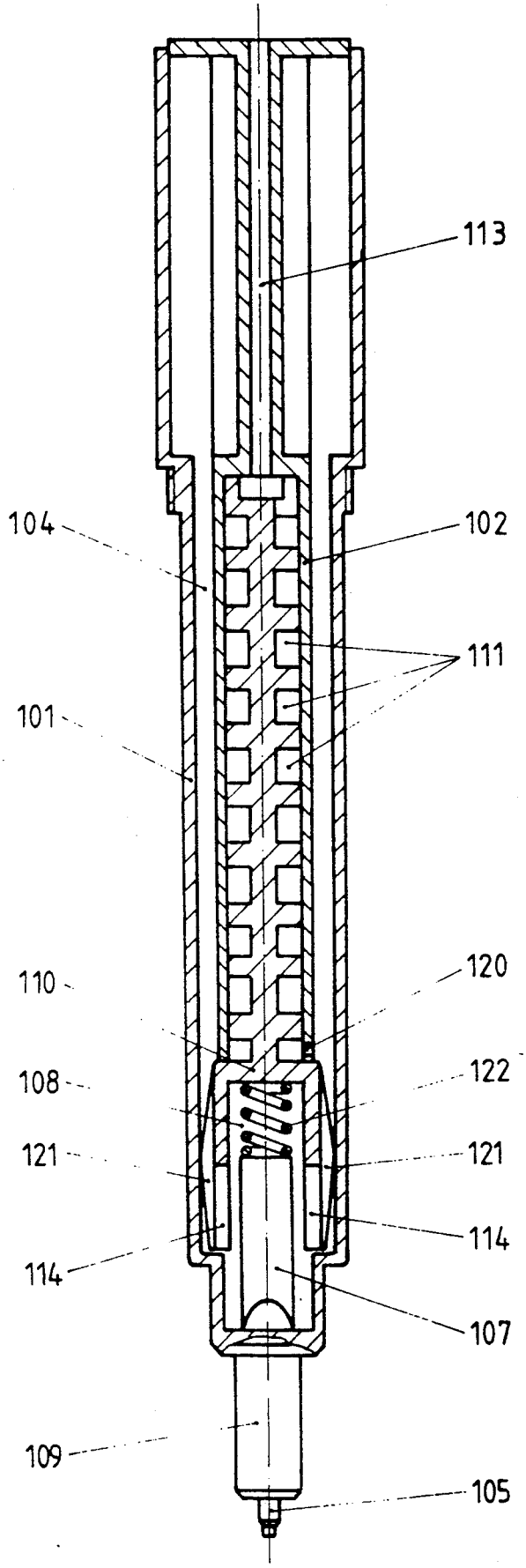
FIG. 3 is a partial sectional front view of a second embodiment of a technical pen in accordance with the present invention.

FIG. 3 illustrates another exemplary embodiment of a technical pen, where the open channel structure of the pressure equalization chamber 111 is located behind the inner bore 108, and is part of a one-piece inner section 110. A cover 102 has been pushed over the back end of the inner section 110, so the cover, together with the open channels, forms a pressure equalization chamber 111. The chamber front end is located adjacent to the front end of the inner bore 108 and the chamber rear end is located at the back end of the inner section 110. The back end of the pressure equalization chamber 111 is connected with the ambient air by means of a tube section 113, which is formed as a continuation of the cover 102. The inner section 110 and the cover 102 are inserted into an chamber part 101. The oblong chamber 101 has an annular chamber, formed around the wall of the inner bore 108 the cover 102, and the tube-shaped section 113. This structure together forms a cylindrical annular writing fluid reservoir 104. The wall of inner section 110 in the area of the inner bore 108 has guide ribs 121, which protrude outwardly and extend axially. With the help of the guide ribs 121, the inner section 110 is maintained in its position in the chamber part 101, while its front end lies against a shoulder in the chamber part 101. A section of the chamber part 101 located ahead of the shoulder together with the inner bore 108 of inner section 110 receives a drop weight body 107. On the drop weight body front end a cleaning wire (not shown) is fastened in a conventional manner, so as to extend into the writing tube 105, which is fastened within a cylinder section 109 that is formed at the fron end of the chamber section 101. A compression spring 122 stresses the drop weight body 107 in the direction towards the writing tube 105.

By means of lateral openings 114, of inner section 110, the writing fluid reservoir 104 is connected with the inner bore 108, so that writing fluid can flow out of the writing fluid reservoir into the inner bore 108 and to the writing tube 105.

At its forward located, inner end, the pressure equalization chamber 111 is connected via a lateral bore 120 with the writing fluid reservoir. It is possible for air to enter the writing fluid reservoir 104 via the tube-shaped section 113 and the pressure equalization chamber 111. Writing fluid can be pushed through the lateral bore 120 into the pressure equalization chamber 111 in order to cause equalization of the pressure.

While the present invention has been described with respect to what presently are considered to be the preferred embodiments, it is to be understood that the invention is not limited to the disclosed embodiments. To the contrary, the present invention is intended to cover various modifications and equivalent arrangements included with the spirit and scope of the appended claims. The following claims are to be accorded a broad interpretation, so as to encompass all such modifications and equivalent structures and functions.

I claim:

1. A technical pen, suitable for use in drafting plotters, said pen comprising a writing tube (5) provided in a front end of the pen, and into which a cleaning wire (6) extends from a rear direction, said cleaning wire being fixed at a front end of a drop weight body (7) which is movable back and forth axially to a limited degree in an inner bore (8), said inner bore (8) being connected with a writing fluid reservoir (4), wherein coaxially to the inner bore a pressure equalization chamber (11) is provided, a front end of said pressure equalization chamber (11) being connected with said writing fluid reservoir (4) and the other end of said pressure equalization chamber being connected with ambient air, wherein further said writing fluid reservoir (4) forms an annular chamber that coaxially surrounds at least a front section of said inner bore (8), and at least a portion of the pressure equalization chamber (11) is connected proximate the front end through at least one lateral opening (14) to said inner bore (8), whereby the front end of said pressure equalization chamber (11) is proximate the front end of the inner bore, and the other end of said pressure equalization chamber (11) is proximate a rear end of the technical pen.

2. A technical pen according to claim 1, wherein an exterior wall of the writing fluid reservoir (4) is formed by a front part (1) into which an interior part (9, 10) containing said writing tube (5) and said inner bore (8) has been inserted.

3. A technical pen according to claim 2, wherein said pressure equalization chamber (11) concentrically surrounds said inner bore (8).

4. A technical pen according to claim 2, wherein said pressure equalization chamber (11) extends backwards over a back end of said writing fluid reservoir (4).

5. A technical pen according to claim 4, wherein said pressure equalization chamber comprises an open channel structure and a cover, and wherein in an area behind said fluid reservoir (4), said cover comprises a resilient, open-pored material (12) that communicates the pressure equalization chamber with ambient air.

6. A technical pen according to claim 5, wherein said pressure equalization chamber in an area of the writing fluid reservoir (4) comprises a cylinder wall (2) that is fixedly connected with said front part (1).

7. A technical pen according to claim 6, wherein said interior part (9, 10) is displaceable between a retracted locked position, where said cylinder wall (2) sealingly closes off the at least one lateral opening (14) between said writing fluid reservoir (4) and said inner bore (8), and a forward operating position, in which the at least one lateral opening (14) connects said writing fluid reservoir (4) and said inner bore (8).

8. A technical pen, suitable for use in drafting plotters, said pen comprising a writing tube (105) provided in a front end of the pen and into which a cleaning wire (106) extends from a rear direction, said cleaning wire being fixed at a front end of a drop weight body (107) which is movable back and forth axially to a limited degree in an inner bore (108), said inner bore being connected with a writing fluid reservoir (104), wherein coaxially to the inner bore a pressure equalization chamber (111) is provided, a front end of said pressure equalization chamber 111 being connected with said writing fluid reservoir and the other end of said pressure equalization chamber being connected with ambient air, wherein further said writing fluid reservoir (104) forms an annular chamber that coaxially surrounds at least a section of said inner bore (108), and at least a portion of the pressure equalization chamber (111) is connected proximate the front end through at least one lateral opening (114) to said inner bore (108), whereby the front end of said pressure equalization chamber (111) is proximate the front end of the inner bore, and the other end of said pressure equalization chamber (111) is proximate a rear end of the technical pen, wherein said pressure equalization chamber (111) is located behind said inner bore (108).

9. A technical pen according to claim 8, wherein the entire pressure equalization chamber (111) is surrounded by said writing fluid reservoir (104) and said other end of said pressure equalization chamber is connected with ambient air via a tube section (113) that is sealed with respect to the writing fluid reservoir (104).

10. A technical pen according to claim 8, wherein a wall of said inner bore (108) and a section (110) having an open channel structure which forms said pressure equalization chamber (111) is made of one piece.

11. A technical pen according to claim 10, wherein an exterior wall of said writing fluid reservoir (104) is formed by a chamber part (101), and said writing tube (105) is provided at a front end of said chamber part.

* * * * *